United States Patent [19]

Iwaki et al.

[11] Patent Number: 4,824,336

[45] Date of Patent: Apr. 25, 1989

[54] VACUUM PUMP

[75] Inventors: Yoshiyuki Iwaki, Himeji; Akio Matsumoto, Hyogo; Kimiaki Seki, Kasai, all of Japan

[73] Assignee: Mitsubishi Denki Kabushiki Kaisha, Tokyo, Japan

[21] Appl. No.: 180,199

[22] Filed: Apr. 21, 1988

Related U.S. Application Data

[63] Continuation of Ser. No. 6/908,971, Sep. 17, 1986, abandoned, which is a continuation of Ser. No. 6/685,898, Dec. 24, 1984, abandoned.

[30] Foreign Application Priority Data

Dec. 26, 1983 [JP] Japan ..... 58-203637[U]

[51] Int. Cl.[4] ..... F04B 17/00

[52] U.S. Cl. ..... 417/415; 417/369; 417/413; 74/55

[58] Field of Search ..... 417/366, 369, 374, 413, 417/470, 269, 415, 410; 74/55, 60; 92/71

[56] References Cited

U.S. PATENT DOCUMENTS 3,183,848 5/1965 Raymond ..... 74/60
4,301,716 11/1981 Saegusa et al. ..... 417/269

FOREIGN PATENT DOCUMENTS 2805846 8/1979 Fed. Rep. of Germany ..... 417/269

*Primary Examiner*—Donald E. Stout
*Attorney, Agent, or Firm*—Oblon, Fisher, Spivak, McClelland & Maier

[57] ABSTRACT

A vacuum pump comprises a slide shaft having one end provided with a discharging valve and a diaphragm, a cam plate in press-contact with the other end of the slide shaft to cause reciprocating movement of the slide shaft, a shaft of a motor for rotating the cam plate and a bearing casing for holding a bearing which supports the motor shaft in a freely rotatable manner, wherein the cam plate is provided at its one side surface with a recess for receiving the bearing and provided at its other side surface with a cam surface.

4 Claims, 3 Drawing Sheets

VACUUM PUMP

This application is a continuation of application Ser. No. 06/908,971, filed on Sept. 17, 1986, now abandoned, which was a continuation of application Ser. No. 06/685,898, filed 12/24/84, also abandoned.

BACKGROUND OF THE INVENTION

1. Field of the Invention

The present invention relates to a vacuum pump driven by a motor. More particularly, it relates to an improvement in a vacuum pump of a type in which a slide shaft provided with a diaphragm is reciprocated at a predetermined stroke by means of a cam plate rotated by a motor.

2. Description of Prior Art

FIG. 1 shows a conventional vacuum pump. The conventional vacuum pump has a bearing casing 12 holding a bearing 1A which supports a motor shaft 2 in a freely rotatable manner and a slide shaft 6 provided at its one end with discharge valves 17 and a diaphragm 7 which are essential parts of the vacuum pump. A cam plate 3 connected to the motor shaft 2 is positioned between the bearing 1A and the other end of the slide shaft 6 to cause reciprocating movement of the slide shaft 6 at a predetermined stroke. In the conventional vacuum pump, use of a relatively thick cam plate rendered the length of the vacuum pump in the axial direction to be large and the demand for forming the vacuum pump into a compact form has been restricted.

SUMMARY OF THE INVENTION

It is an object of the present invention to provide an improved vacuum pump which allows reduction in the distance between a motor and a slide shaft in their axial directions to make the vacuum pump in a compact form.

The present invention is to provide a vacuum pump having a reduced length in the axial direction by fitting a bearing casing 12 holding a bearing which supports a motor shaft in a freely rotatable manner, in a recess formed in a cam plate to shorten the distance between the bearing casing and a slide shaft. The cam plate has an annular cam surface extending both axially and circumferentially with respect to the cam plate, wherein more than one half of the annular cam surface is positioned rearwardly of the bottom surface of the recess.

In one aspect of the present invention there is provided a vacuum pump which comprises a slide shaft having one end provided with a discharging valve and a diaphragm, a cam plate in press-contact with the other end of the slide shaft to cause reciprocating movement of the slide shaft, a shaft of a motor for rotating the cam plate and a bearing casing for holding a bearing which supports the motor shaft in a freely rotatable manner, wherein the cam plate is provided at its one side surface with a recess for receiving the bearing and provided at its other side surface with a cam surface.

DETAILED DESCRIPTION OF THE PREFERRED EMBODIMENT

Figure 1:
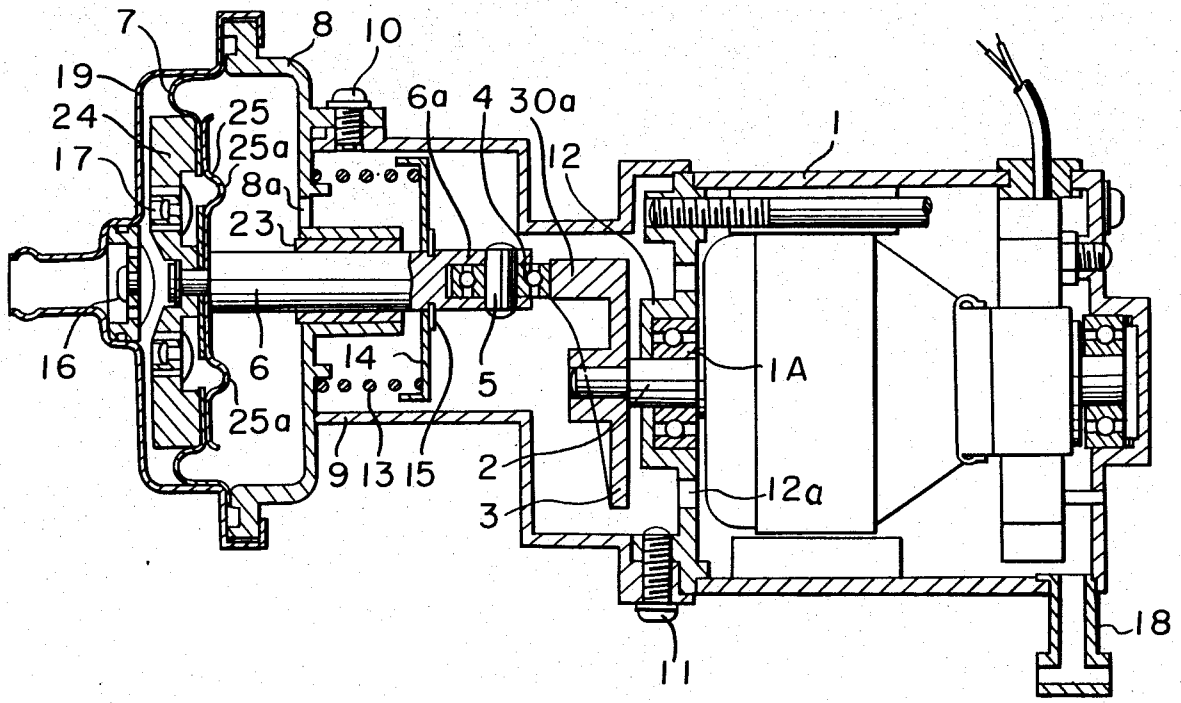
FIGURE 1 PRIOR ART
FIG. 1 is a longitudinal cross-sectional view of a conventional vacuum pump.
Figure 2:
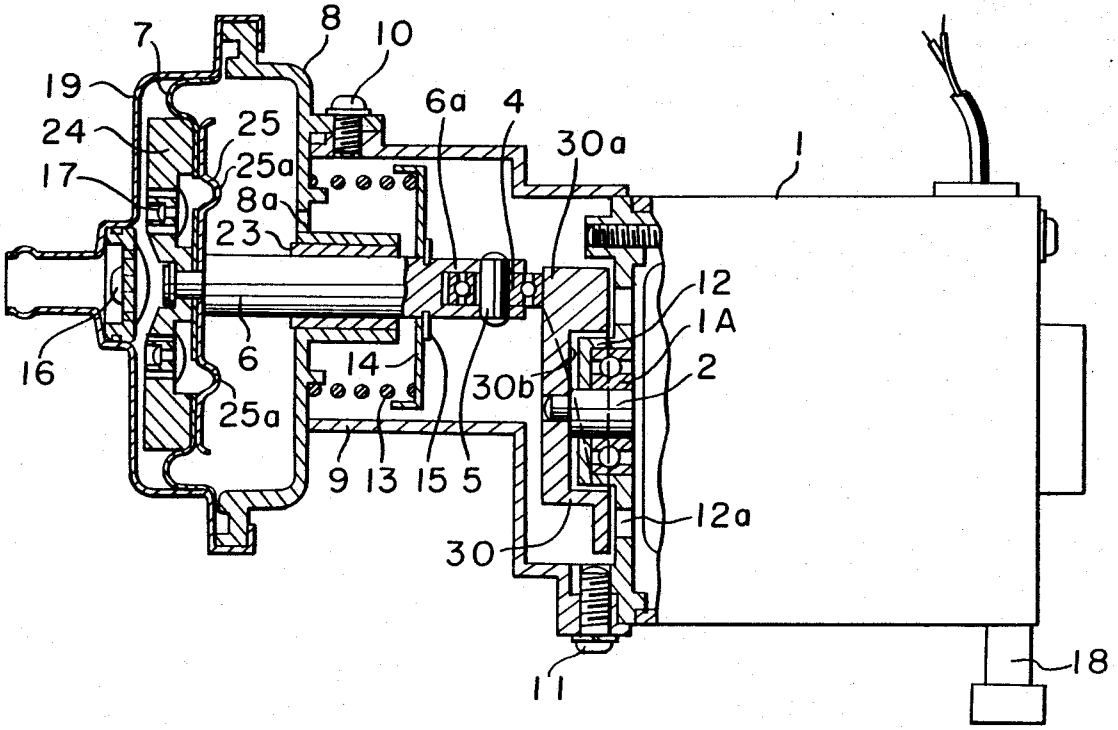
FIG. 2 is a longitudinal cross-sectional view of an embodiment of the vacuum pump according to the present invention.

FIG. 2 is a cross-sectional view showing an embodiment of the vacuum pump of the present invention. In FIG. 2, a motor 1 comprises a motor shaft 2 whose free end is provided with a cam plate 30 which will be described later in detail with reference to FIGS. 3 and 4. In the peripheral part of a side surface of the cam plate 30, an annular cam 30*a* in which the height of a projecting part is gradually changed in the axial direction is formed. A slide shaft 6 is positioned at the substantially central part of a vacuum pump housing 8 having an air vent 8*a* through a thrust bearing 23 so as to be reciprocatingly moved. There is formed a forked part 6*a* at an end of the slide shaft 6 and a low frictional member 4 such as a ball-bearing is fitted to the forked part 6*a* through a journal pin 5 in a rotatable manner. The outer circumferential surface of the bearing 4 is brought into contact with and is rolled on an end surface of the annular cam 30*a* with a predetermined pressure by means of a compression spring 13. At the other end of the slide shaft 6, there is firmly attached a diaphragm 7 which is clamped by a valve body 24 having a plurality of discharging valves 17 and a pressing plate 25 having a plurality of air lengths 25*a*. An air-intake valve 16 is attached at the substantially central part of a cover 19 which closes an end opening of the housing 8 of the vacuum pump. The housing 8 of the vacuum pump and an intermediate housing 9 are connected by means of a bolt 10. The bearing casing 12 receiving the bearing 1A for rotatably supporting the motor shaft 2 of the motor 1 and the intermediate housing 9 are connected by means of a bolt 11. A retaining ring 15 is fitted to the slide shaft 6 to secure a spring bearing 14 to it. The spring bearing 14 bears one end of the compressing spring 13 which brings the outer circumferential surface of the bearing 4 into press contact with the end surface of the annular cam 30*a*. A reference numeral 18 designates a discharging pipe attached to the lower part of the yoke of the motor 1.

Figure 3B:
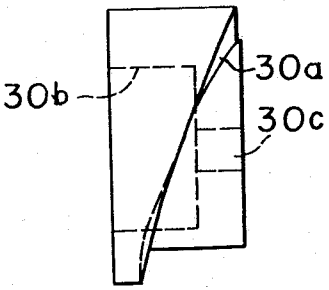
FIGS. 3A-3C are respectively a front view and right and left side views of an embodiment of the cam plate used in the present invention.
Figure 3A:
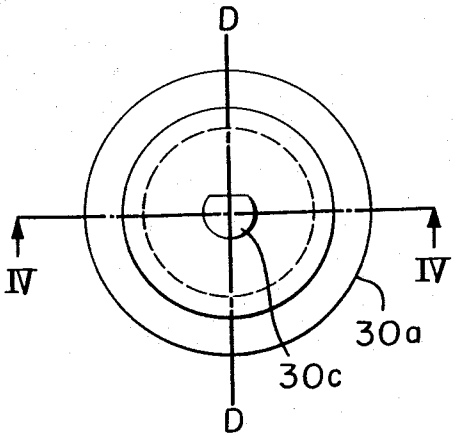
Figure 3C:
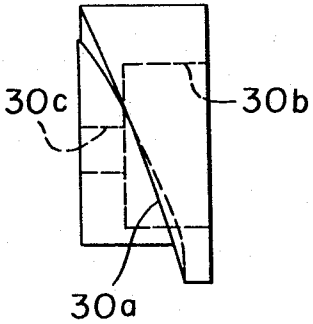
Figure 4:
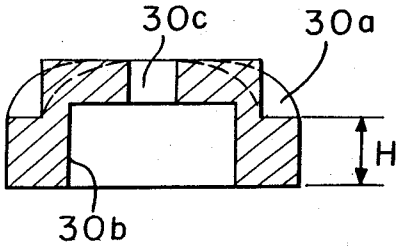
FIG. 4 is a cross-sectional view taken along the line IV-IV in FIG. 3A.

FIGS. 3A to 3C are respectively a front view and left and right side views of the cam plate 30 used in the present invention, and FIG. 4 is a cross-sectional view taken along the line IV—IV in FIG. 3A. The cam plate 30 is provided with the annular cam surface 30*a* in the circumferential part of a side surface on the side of the slide shaft 6. The cam surface 30*a* is formed in a symmetrical manner with respect to the line D—D in FIG. 3A, and the cam surface is drawn by a sine curve in which the height of the projecting part is gradually changed in the axial direction. In the side surface of the cam plate 30 facing the motor 1, there is provided a recess having a bottom surface 30*b* for receiving the bearing casing 12 holding the bearing 1*a* which rotatably supports the motor shaft 2. By fitting the bearing casing 12 in the recess 30*b*, the distance between the bearing casing 12 and the bearing 4 attached to the slide shaft 6 can be shortened, whereby the length of the vacuum pump is reduced. A fitting hole 30*c* is formed in the central portion of the cam plate 30 to be connected to the free end of the motor shaft 2. More than one half of the annular cam surface 30*a* is positioned rearwardly of the bottom surface 30*b* of the axial recess.

In the vacuum pump having the construction as mentioned above, when the cam plate 30 is rotated along with the motor shaft 2 of the motor 1, the bearing 4 in press-contact with the end surface of the annular cam 30*a* of the cam plate 30 by means of the compression spring 13 causes the slide shaft 6 to reciprocatingly move at a predetermined stroke in accordance with the curved surface of the annular cam 30*a*. By the reciprocating movement of the slide shaft 6, air is sucked from the air-intake valve 16 in the movement of the slide shaft in one direction and air is discharged from the discharging valve 17 in the opposite direction. Thus, the air is passed through the air length 25*a* of pressing plate 25, an air vent 8*a* of the housing 8 and an air vent 12*a* of the bearing casing 12 and is finally discharged through the discharging pipe 18. Thus, function as a vacuum pump is performed.

In the vacuum pump of the present invention, since the recess having the bottom surface 30*b* is formed in the cam plate 30 having relatively large thickness to receive the bearing casing 12 holding the bearing 1*a* which rotatably supports the motor shaft 2, the distance between the bearing casing 12 and the bearing 4 of the slide shaft 6 is shortened accordingly the length of the vacuum pump is reduced, and, the vacuum pump is in a compact form.

What is claimed is:

1. A vacuum pump comprising:

(a) a slide shaft mounted for axial reciprocal movement;

(b) a motor encased in a motor housing having a forward face having a forward surface;

(c) a bearing mounted in said forward face of said motor housing and extending forwardly therefrom;

(d) a motor shaft journaled in said bearing and extending forwardly therefrom;

(e) a cup-shaped bearing case comprising a planar bottom and a cylindrical lip surrounding the forward extension of said bearing, (i) the forward surface of said bearing making planar contact with the rearward surface of said planar bottom of said bearing case, (ii) the outer surface of the forward extension of said bearing making cylindrical contact with the inner surface of said cylindrical lip, (iii) the rearward surface of said cylindrical lip making planar contact with said front surface of said forward face of said motor housing, and (iv) said motor shaft extending through a hole in said planar bottom of said cup-shaped bearing case; and (f) a cam plate mounted on said motor shaft for rotary motion therewith, (i) said cam plate comprising a cylindrical body having a first axial surface facing said motor housing and a second axial surface facing said slide shaft, (ii) said first axial surface of said cam plate being coplanar with the rearward surface of said cylindrical lip, (iii) said cam plate containing an axial recess sized, shaped, and positioned to closely receive but not to contact the outer surface of said cylindrical lip and the forward surface of said planar bottom of said bearing case, said axial recess having a bottom surface defining an end of a bore into which said motor shaft is fitted, and (iv) said second axial surface of said cam plate having an annular cam surface therein sized, shaped, and positioned to engage said slide shaft so that rotary motion of said cam plate is translated into axial motion of said slide shaft, wherein said annular cam surface extends both axially and circumferentially with respect to said cam body, and wherein more than one half of said annular cam surface is positioned rearwardly of said bottom surface of said axial recess.

2. A vacuum pump as recited in claim 1 and further comprising means for biasing said slide shaft into engagement with said cam surface.

3. A vacuum pump as recited in claim 1 wherein said cam surface is symmetrical with respect to a central plane parallel to said motor shaft.

4. A vacuum pump as recited in claim 1 wherein said cam surface is a sin curve.

* * * * *